US007503198B1

(12) United States Patent
Ghiran et al.

(10) Patent No.: US 7,503,198 B1
(45) Date of Patent: Mar. 17, 2009

(54) SLUG EXPANDING AND CAPTURING APPARATUS AND METHOD FOR HYDROFORMING APPLICATION

(75) Inventors: Mike M. Ghiran, Lake Orion, MI (US); Vincent J. Sychta, Lake Orion, MI (US); George W. Bachelor, Brighton, MI (US); Terry A. Kent, East China, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/027,359

(22) Filed: Feb. 7, 2008

(51) Int. Cl.
*B21D 28/28* (2006.01)

(52) U.S. Cl. ..... 72/55; 29/421.1; 83/53; 72/336

(58) Field of Classification Search ..... 72/54, 72/55, 56, 58, 336; 29/421.1; 83/53
See application file for complete search history.

(56) References Cited

U.S. PATENT DOCUMENTS 5,666,840 A * 9/1997 Shah et al. ..... 72/55
5,765,420 A * 6/1998 Schaefer ..... 72/55
5,799,524 A * 9/1998 Schafer et al. ..... 72/55
6,067,830 A * 5/2000 Klages et al. ..... 72/55
6,098,437 A * 8/2000 Kocer et al. ..... 72/55
6,305,201 B1 * 10/2001 Ghiran et al. ..... 72/55
6,434,989 B1 * 8/2002 Hardtke ..... 72/55
6,442,820 B1 * 9/2002 Mason ..... 29/421.1
6,658,908 B1 * 12/2003 Ghiran et al. ..... 72/55
7,127,924 B1 * 10/2006 Ghiran ..... 72/55
7,204,113 B1 * 4/2007 Ghiran et al. ..... 72/55

* cited by examiner

*Primary Examiner*—David B Jones

(57) ABSTRACT

An apparatus and method for piercing a hole in a work piece suitable for hydroforming applications is provided. The apparatus includes first and second die portions forming a die cavity for the work piece. Each die includes a punch cavity generally perpendicular to the work piece. One of the punch cavities has a slug capturing area. A punch with an angular cutting face can be moved within a cross passage created by the punch cavities to impact the work piece. The angular cutting face of the punch has a larger surface area than the punch body, which results in expanding slugs pierced from the work piece. The slug capturing area is configured with a cross-sectional area smaller than the surface area of the angular cutting face.

18 Claims, 5 Drawing Sheets

SLUG EXPANDING AND CAPTURING APPARATUS AND METHOD FOR HYDROFORMING APPLICATION

TECHNICAL FIELD

This invention relates to piercing holes in hydroformed parts during the hydroforming process.

BACKGROUND OF THE INVENTION

Hydroforming is used to create parts because of its ability to integrally form a hollow tube, beam, or other member with a complex shape that would otherwise have to be fabricated from several pieces and/or bent into shape. A thin-walled blank is inserted into a die cavity that closely matches the exterior of the part to be created. Then the tube is pressurized with a hydraulic fluid to expand it into the shape of the die cavity. If further processes are required, the completed part is depressurized and removed.

Hydroforming allows complex shapes with concavities to be formed, which would be difficult or impossible with standard solid die stamping. Hydroformed parts can often be made with a higher stiffness to weight ratio and at a lower per unit cost than traditional stamped or stamped and welded parts.

Often, various holes or openings may be desired in the wall of the final part. These may be drilled or cut after the fact, but it may also be desired to incorporate the hole piercing process into the hydroforming process itself. Incorporation of the hole piercing process is beneficial to reduce the total number of steps in the manufacture of the part, and may have other benefits such as: reduced failure rates, reduced scrap material, tighter tolerances, et cetera.

SUMMARY OF THE INVENTION

An apparatus for piercing holes in a sufficiently thin-walled part suitable for hydroforming applications is provided. The apparatus includes upper and lower dies that form a die cavity into which the blank part is placed. The upper and lower dies include cavities, which together define a cross passage perpendicular to the part. The cross passage holds and guides an angular punch, which is used to pierce holes in the part as it is forced through the part and die cavity. The angular punch has an elongated body with a cutting face on one end—the other end being used to actuate the punch and advance it through the part. On the piercing end of the punch, the angular cutting face is configured to expand or distend the slug created by piercing a hole in the part. Expansion or distension results in a slug that has an area larger than that of the cross-sectional area of the punch. After a second slug is created, by piercing a hole in the opposite wall of the part, the punch advances through a slug capturing area. Because the slug capturing area is smaller than the expanded slugs, when the punch retracts back to its starting position, the slugs are knocked off of the cutting face and are discarded or removed from the system.

A method for piercing holes in a sufficiently thin-walled part suitable for hydroforming applications is provided. In the first step, a work piece is provided within a die cavity. The work piece is then subjected to hydraulic pressure, such that it expands to fill the die cavity. A punch is then forced through the work piece, which pierces a hole in the work piece and creates a slug therefrom. As the slug breaks away from the work piece, it expands as the material relaxes; this expansion makes the diameter of the slug larger than the diameter of the punch. The slug is then passed through a slug capturing area, which has a cross section smaller than the slug diameter. After the slug clears the slug capturing area, the punch reciprocates back to its original position. As the face of the punch retracts beyond the slug capturing area, the slug is too large to follow the punch back through, and the slug is stripped off of the punch.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 3 shows the addition of hydraulic pressure in the work piece, which flexes the unsupported portions of the work piece walls;

FIG. 4 shows the punch advancing into the first wall of the work piece as the angular face begins to separate the first slug;

FIG. 5 shows the separated first slug as it moves into the interior of the work piece and relaxes away from the angular face;

FIG. 6 shows the first slug and punch as they impact the second wall of the work piece;

FIG. 7 shows the first and second slugs being compressed as they move through the converging conical portion of the button interior;

FIG. 8 shows the expanded first and second slugs after being stripped from the angular face by the slug capturing area as the work piece loses hydraulic pressure; and FIG. 9 shows the first and second slugs falling out of the system through the ejection chute as the punch reciprocates.

DESCRIPTION OF THE PREFERRED EMBODIMENTS

Figure 1:
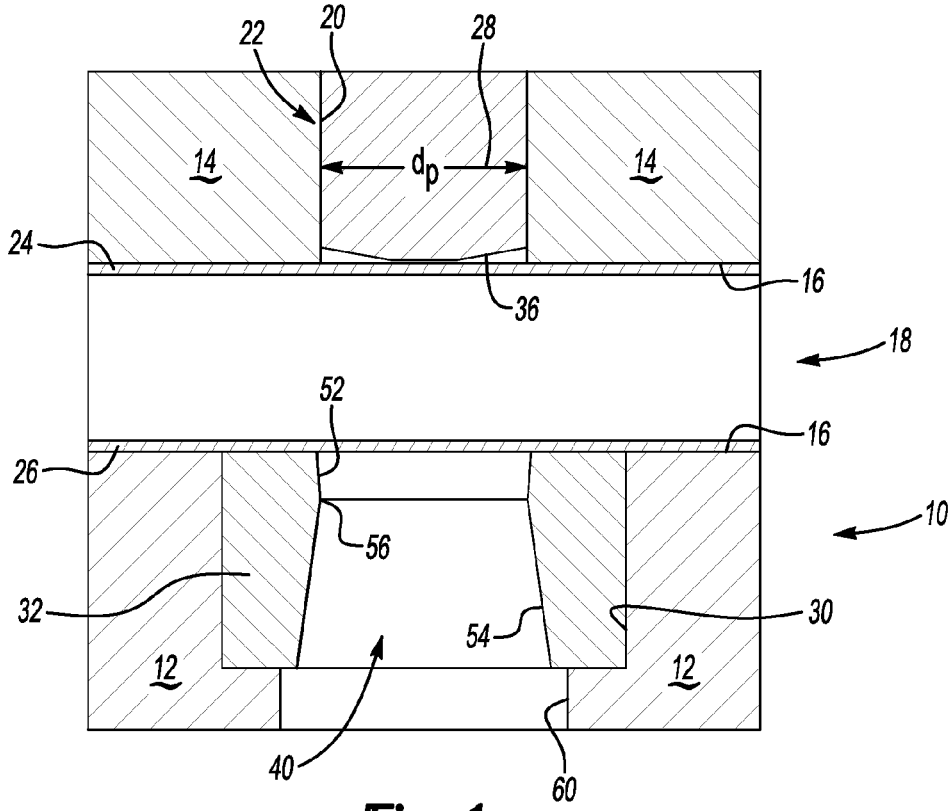
FIG. 1 is a fragmentary schematic cross section of an embodiment of a slug expanding and capturing apparatus.

Referring to the drawings, wherein like reference numbers correspond to like or similar components throughout the several figures, there is shown in FIG. 1 a schematic cross section of an embodiment of a slug expanding and capturing apparatus 10. Three die portions—a first or upper die portion 14, a second or button die portion 32, and a third or lower die portion 12—form a die cavity 16, into which a thin-walled work piece 18 is placed.

Those skilled in the art will recognize that the die cavity 16 can be almost any shape or size. The inner surface of the die cavity acts as a negative mold that has the shape of the desired final part. Innumerable different thin-walled beginning parts 18 may be used, so long as they are suitable for hydroforming into the desired final part shape. As used in this application, the term "wall" should be read broadly enough to encompass even two sides of a cylindrical tube with no distinct, opposing walls as such. Those skilled in the art will further recognize that a slug expanding and capturing apparatus within the scope of the claims does not have to be oriented exactly as shown in the drawings, and terms such as "upper," "lower," "above," et cetera, are used only descriptively of directions in these drawings.

Referring again to FIG. 1, upper die portion 14 includes a punch cavity 20 oriented above, and generally perpendicular to, the part or work piece 18. The punch cavity 20 acts as a housing and guide for actuation of a punch 22. The desired holes in the work piece 18 are created when punch 22 is actuated to impact, and then move through, a first wall 24 and then a second wall 26 of work piece 18. The punch 22 will be described in more detail below.

In this embodiment, the lower die portion 12 has a button cavity 30 which is configured to house the button die portion 32 such that the button die portion 32 is flush mounted with the top of the lower die portion 12 and effectively forms a defining part of the die cavity 16. The button die portion 32 has an inner cavity, button interior 40, which is generally perpendicular to work piece 18. The button interior 40 is described in more detail below. Together, the punch cavity 20 and the button interior 40 provide a cross passage that runs generally perpendicularly across the work piece 18 and meets both walls 24 and 26 thereof. This cross passage defines the operational path of punch 22. Additionally, the areas at which the cross passage intersects the work piece 18 roughly define the outer edges of the holes which will be pierced in the final part. In general terms, explained in more detail below, the punch is hydraulically forced or actuated through walls 24 and 26 and creates holes defined by the cross-sectional shape of the punch 22 as it pierces the material.

Figure 2:
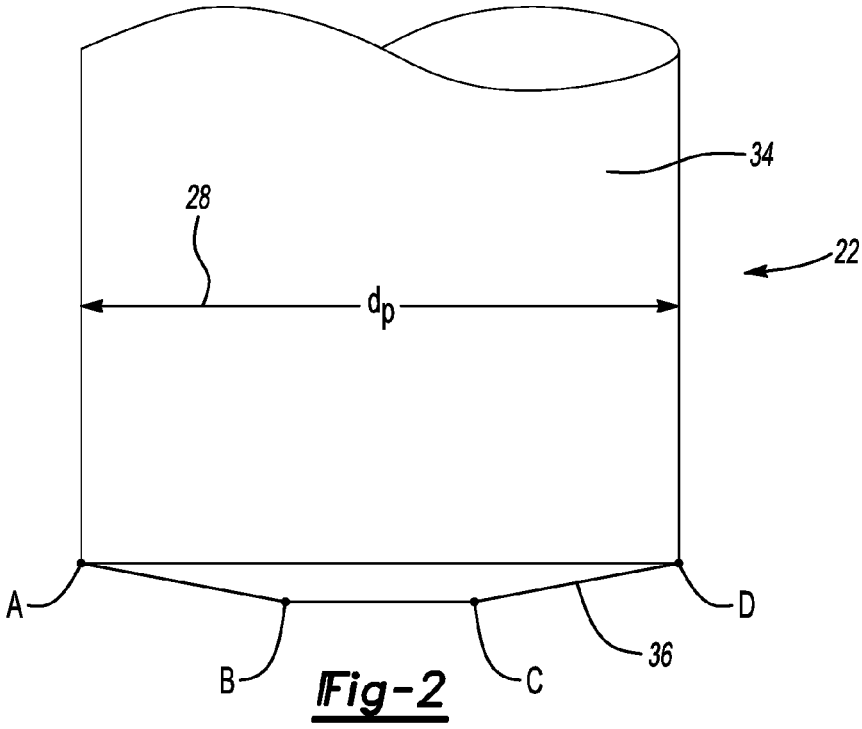
FIG. 2 is a side view of a portion of the punch shown in FIG. 1.

FIG. 2 shows a portion of punch 22 in greater detail. Punch 22 includes two primary features, an elongated body 34 and an angular face 36. The angular face 36 is an angular or convex boss, extending outward from elongated body 34 toward the work piece 18. Angular face 36 is configured such that it has a total surface area larger than the cross-sectional area of elongated body 34. Put another way, as viewed in the two-dimensional drawings of FIGS. 1 and 2, the total length ($d_f$, not labeled in the figures) of the line connecting points A, B, C, and D, representing the angular face 36, is greater than the length of the line representing the punch cross section 28 ($d_p$). As long as $d_f$ is greater than $d_p$, angular face 36 will have a greater surface area than the cross-sectional area of elongated body 34. As used in this application, "angular face," "angular cutting face," and similar language includes many different shapes of the punching face; as long as the face is configured to expand or distend the material cut away from the work piece 18 (as will be described in greater detail below). Elongated body 34 has a punch cross section 28 which is generally equivalent to the shape and size of the holes desired—any variance being due to normal manufacturing effects which are apparent to those skilled in the art. In this embodiment, the punch is cylindrical and pierces a generally round hole, but other embodiments within the scope of the claims could make use of punches having different shapes, depending upon the specific application and desired cross section of the pierced hole.

The punch 22 can be made from any material capable of repeatedly piercing the work piece 18, such as a suitable tool steel, like M2 58-60 RC; those skilled in the art will recognize many other possibilities. Suitable hydroformable and piercable materials for the work piece 18 include, without limitation: mild steel, high strength steel, aluminum, magnesium, or the equivalents thereof. Wall thickness of the work pierce 18 commonly runs from 0.5 mm to 5.0 mm, but those skilled in the art will further recognize other operable thicknesses for a hydroformable and piercable work piece.

Figure 3:
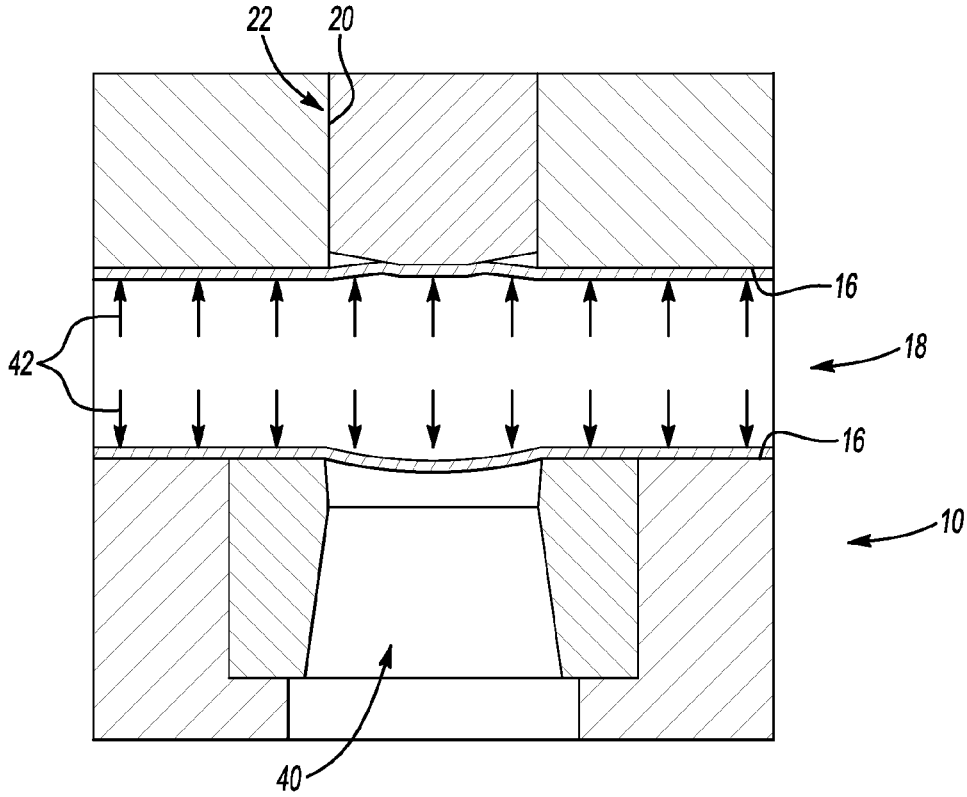
FIGS. 3-9 collectively demonstrate the operation of the slug expanding and capturing apparatus of FIG. 1.

FIGS. 3-9 collectively demonstrate the operation of the slug expanding and capturing apparatus 10 as it pierces a first hole 25 in the first wall 24 and then a second hole 27 in the second wall 26. FIG. 3 shows a cross section of the slug expanding and capturing apparatus 10 of FIG. 1, after hydraulic form pressure 42 is introduced into the interior of work piece 18. When this occurs, work piece 18 expands to match the profile of the die cavity 16. Most embodiments of the slug expanding and capturing apparatus will have a more complex die cavity than that shown in the embodiment of FIGS. 1 and 3-9, but these application-specific details will be understood by those having ordinary skill in the art. As will be recognized by those skilled in the art, hydroforming operating pressures are as low as 5,000 psi and as high as 25,000 psi. As shown in FIG. 3, the introduction of hydraulic form pressure 42 causes portions of the walls 24 and 26 adjacent to the cross passage to expand slightly into the punch cavity 20 and the button interior 40, because the walls 24 and 26 are unsupported by the die cavity in these areas. The pressure on the unsupported areas is insufficient, at the particular wall thickness and pressure used, to passively blow holes through the walls 24 and 26.

Figure 4:
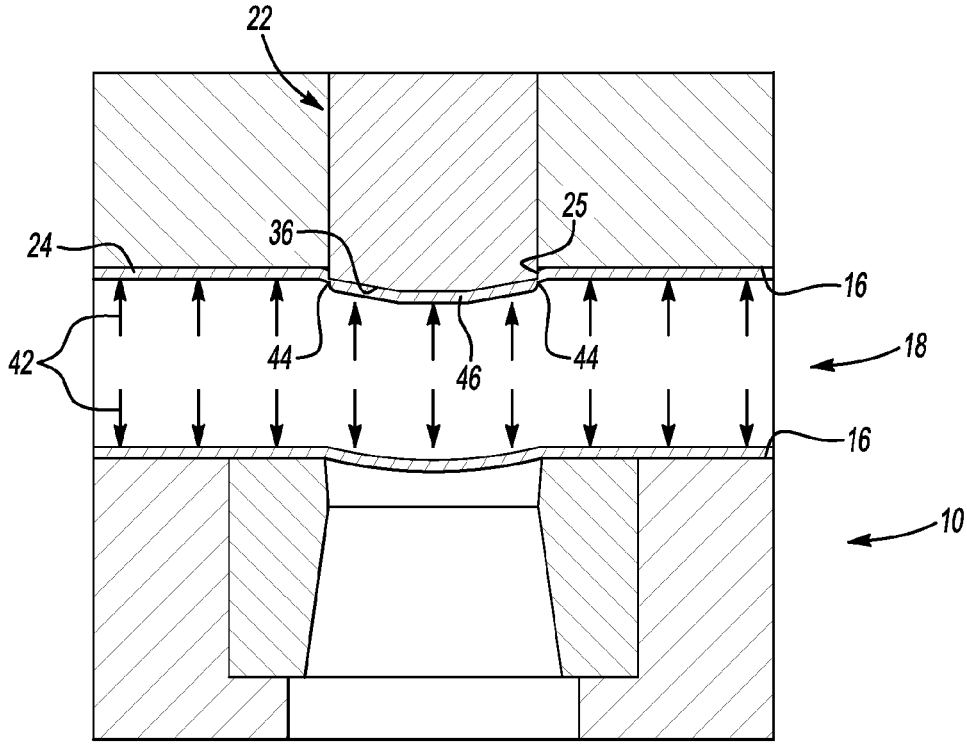

FIG. 4 shows the slug expanding and capturing apparatus 10 as the punch 22 begins moving along its operational path into the work piece 18. Punch 22 can be actuated by hydraulic pressure (not shown) or any other force known to those skilled in the art. The force derived from this pressure drives the punch 22 downward, as shown in FIG. 4, where it impacts the first wall 24 and begins to deform a local area of the wall into the die cavity against the opposing force of the hydraulic form pressure 42. This deformation creates first fracture points 44 at the peripheral juncture between material in contact with the angular face 36 and the die cavity 16. As punch 22 advances further, a first slug 46 is separated from the first wall 24 at the first fracture points 44, creating the first hole 25. Initially, at separation, the first slug 46 is deformed or stretched to closely match the shape of the angular face 36. This deformation results in the slug having an expanded surface area which substantially matches that of the angular face 36.

Figure 5:
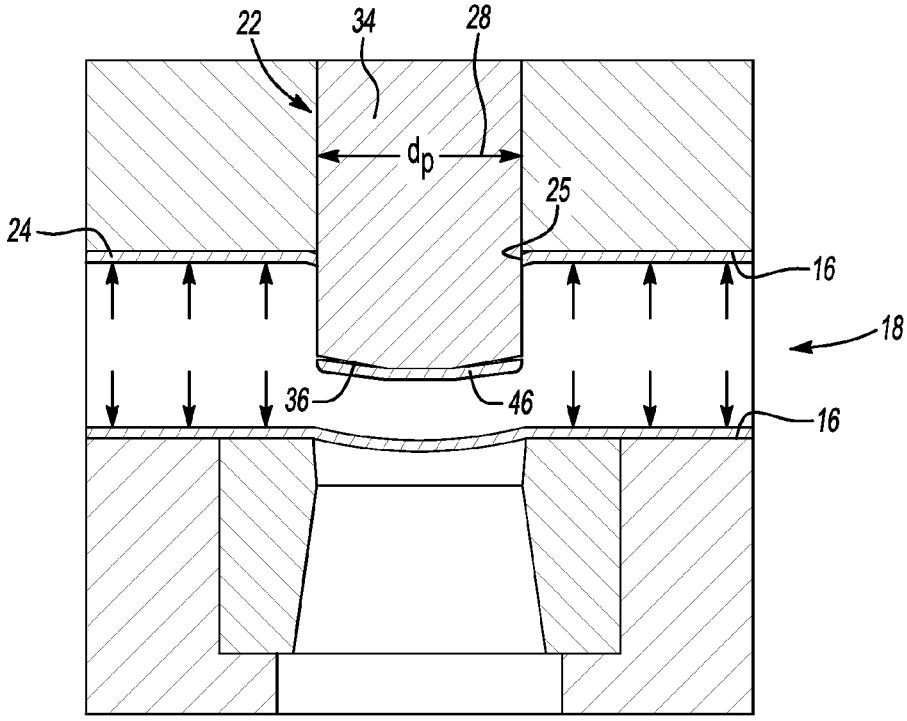

Referring now to FIG. 5, as the punch 22 and the first slug 46 advance past the first wall 24 of the work piece 18 and further into the die cavity 16, the first slug 46 relaxes slightly away from the angular face 36. In this relaxed state, the first slug 46 retains an expanded surface area roughly equal to that of the angular face 36, and has a cross-sectional area, relative to the punch 22, greater than that of the punch cross section 28 of elongated body 34. It should be noted that while the process is broken down into discrete steps for purposes of illustration, the punch 22, in fact, is pushed through work piece 18 and the cross passage very forcefully and rapidly, at speeds up to, and exceeding, 4 inches per second.

Figure 6:
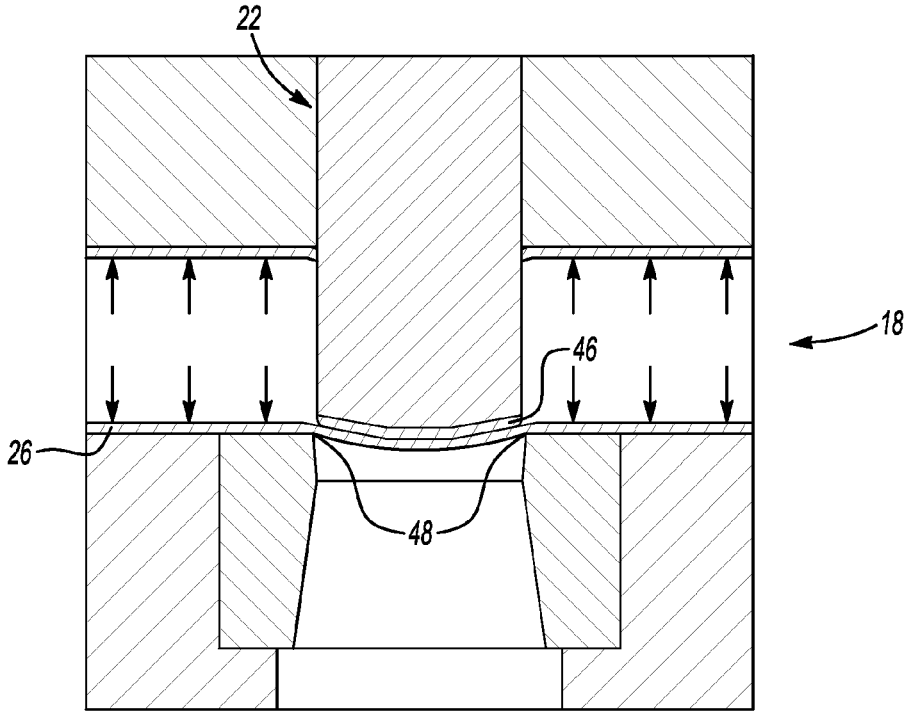
Figure 7:
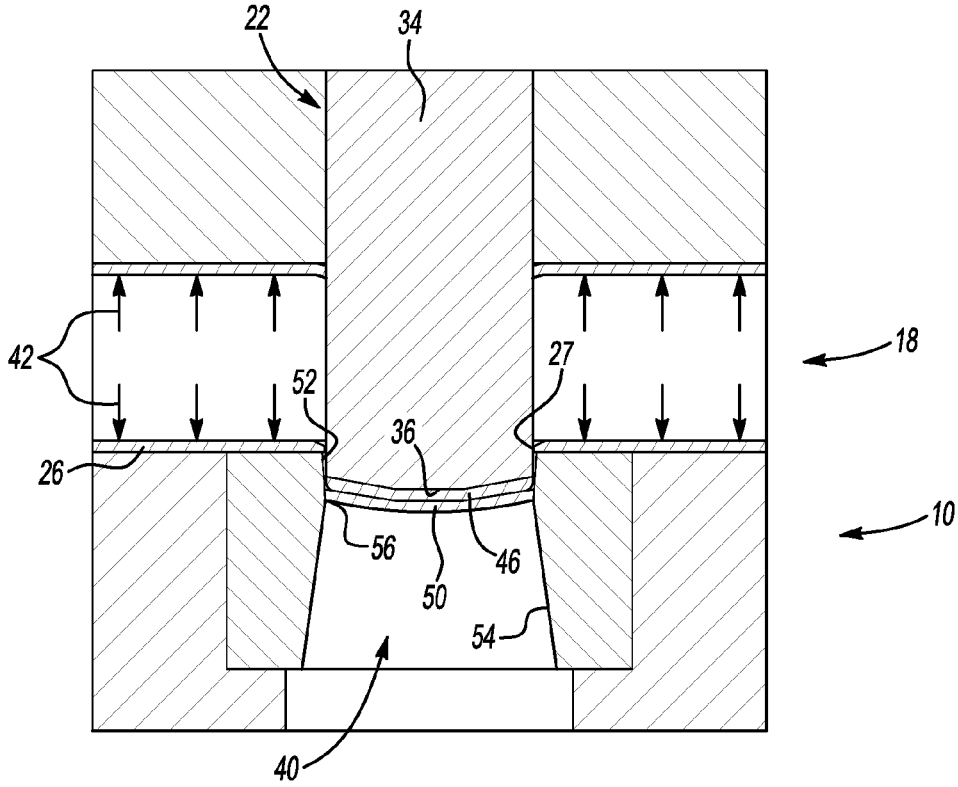

Referring now to FIGS. 6 and 7, creation of the second hole 27 and a second slug 50 are shown. As the punch 22 and the first slug 46 progress through work piece 18, they next impact the second wall 26. Upon impact, second fracture points 48 form at the peripheral juncture between material in contact with the first slug 46 and button die portion 32. As punch 22 advances further, the second slug 50 is separated from the second wall 26 at the second fracture points 48. Upon separation of the second slug 50; punch 22, first slug 46, and second slug 50 move past the die cavity 16 and into the button interior 40.

In this embodiment, the button interior 40 is defined by three features: a converging conical portion 52, a diverging conical portion 54, and a slug capturing area 56. The converging conical portion 52 is a section of a converging cone and the diverging conical portion 54 is a section of a diverging cone. The slug capturing area 56 is at the vertex of the converging and diverging conical portions 52 and 54, and is the area of the button interior 40 having the smallest cross section. In an exemplary embodiment, the clearance between the elongated body 34 of the punch 22 and slug capturing area 56 of the button interior 40 is substantially 0.002-0.005 inches;

which provides sufficient diametrical clearance to provide a slip fit. However, it is possible for the diametrical clearance between elongated body 34 and slug capturing area 56 to be even smaller, including a zero-clearance snug fit.

Operationally, as the slugs 46 and 50 move away from the second wall 26, they are prevented from radially expanding or relaxing by the converging conical portion 52, as best viewed in FIG. 7. The clearance between slug capturing area 56 and elongated body 34 is configured to first allow the slugs 46 and 50 to be pushed through the converging conical portion 52, and then to strip the slugs 46 and 50 as the punch 22 reciprocates upward (as viewed in FIGS. 1-9) past the slug capturing area 56. As long as the slugs 46 and 50 are able to pass the slug capturing area 56 on the down stroke, but not on the reciprocating up stroke, the diametrical clearance between elongated body 34 and slug capturing area 56 is sufficient.

Figure 8:
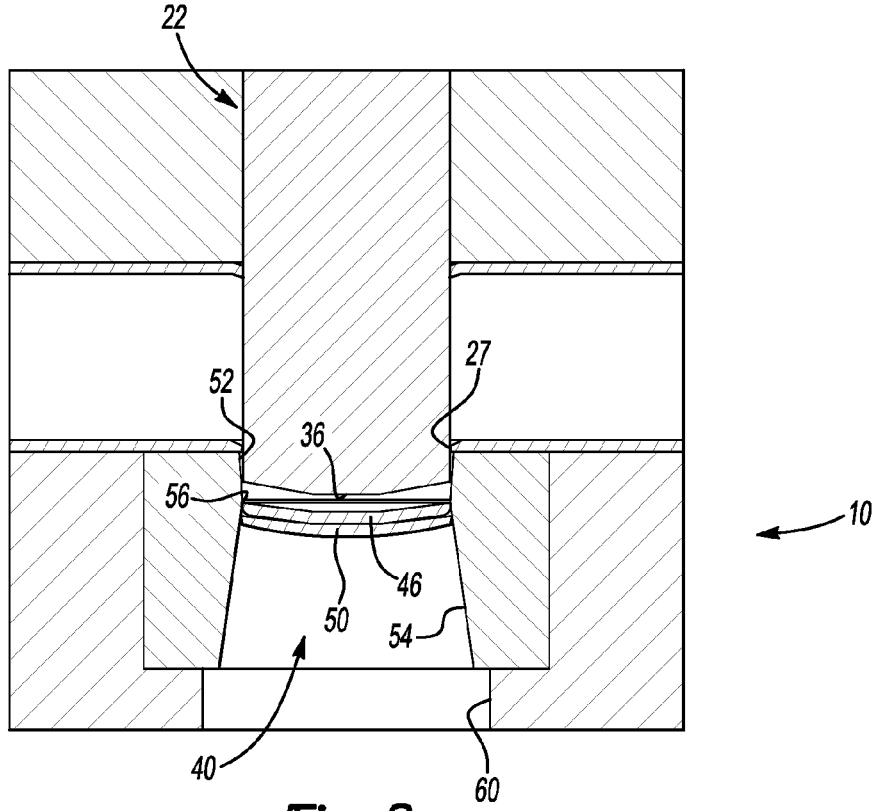
Figure 9:
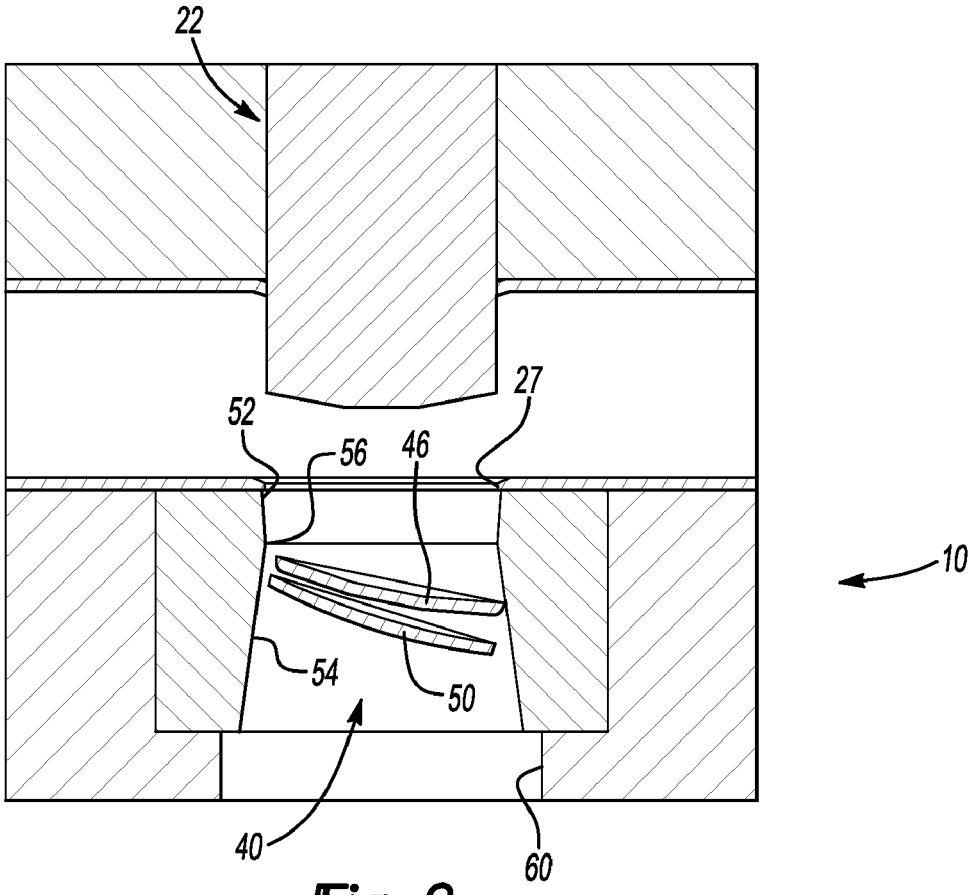

FIGS. 8 and 9 illustrate the release of the first and second slugs 46 and 50 from the slug expanding and capturing apparatus 10. As the angular face 36 of punch 22 advances past the slug capturing area 56, the first and second slugs 46 and 50 are no longer constricted by the converging conical portion 52 and are now free to expand and relax away from the angular face 36. This expansion results in slugs 46 and 50 having a cross-sectional area greater than that of the slug capturing area 56. The actuation of punch 22 then reverses direction and punch 22 begins moving upward, as viewed in FIGS. 8 and 9. As the angular face 36 of punch 22 passes the slug capturing area 56, the expanded first and second slugs 46 and 50 are too wide to pass back through the slug capturing area 56 and are stripped or knocked away from the angular face 36. At this point, the slugs 46 and 50 are loose, and fall through an ejection chute 60. Those skilled in the art will recognize other methods for removing slugs from the apparatus, such as, without limitation: mechanical removal methods, hydraulically ejecting the slugs, et cetera.

Hydraulic form pressure 42 is lost after the punch 22 retracts back beyond the slug capturing area 56 (see FIGS. 7 and 8,) and the internal apparatus is no longer pressure-sealed. Those skilled in the art will recognize that in applications where multiple punches are used to create multiple holes, pressure loss in the system would occur when any one punch retracted past its slug capturing area, or as a result of other components within such a system. Punch 22 then returns to its position within the punch cavity 20, the (now finished) work piece 18 is removed, a new part is provided, and the apparatus repeats the above described process.

This invention also provides a method of piercing holes in hydroformed parts. As illustrated by FIGS. 1-9, the method includes providing a work piece 18 within a die set having a die cavity 16. Sufficient hydraulic form pressure 42 is then applied to the work piece 18, such that the work piece 18 expands in the die cavity 16, at which point the work piece 18 begins to match the shape of the die cavity 16. Next, a punch 22 is advanced sufficiently through a first wall 24 of the work piece to pierce a first hole 25 in the first wall 24 and create a first slug 46 therefrom. As the punch 22 advances through the first wall 24, the first slug 46 is expanded and relaxes away from the punch 22. The expanded first slug 46 passes through a slug capturing area 56 in the die. The slug capturing area 56 has a smaller cross-sectional area than expanded first slug 46, therefore the expanded first slug 46 is capable of passing the slug capturing area 56 only in the downward direction, as viewed in FIGS. 1-9. The punch 22 then reciprocates, and retracts sufficiently back through the slug capturing area 56 to strip the expanded first slug 46 from the punch 22.

While the best modes for carrying out the invention have been described in detail, those familiar with the art to which this invention relates will recognize various alternative designs and embodiments for practicing the invention within the scope of the appended claims.

The invention claimed is:

1. Apparatus for piercing a hole in a work piece suitable for hydroforming applications comprising:

a first die portion having a first punch cavity portion;

a second die portion having a second punch cavity portion;

wherein said first and second die portions define a die cavity configured to receive the work piece, and said first and second punch cavity portions intersect said die cavity;

wherein said second punch cavity portion includes a slug capturing area coaxial with said first punch cavity portion;

a punch having an angular cutting face, configured to move within a cross passage defined by said first punch cavity portion and said slug capturing area of said second punch cavity portion;

wherein said punch has a cross section perpendicular to said cross passage and said angular cutting face of said punch has a surface area greater than said cross section of said punch; and wherein said slug capturing area is configured with a cross-sectional area smaller than said surface area of said angular cutting face.

2. The apparatus of claim 1, further including a third die portion having a button cavity, wherein said second die portion is a button, flush mounted within said button cavity of said third die portion, wherein said slug capturing area is defined by an internal cavity of said button.

3. The apparatus of claim 2, wherein said internal cavity of said button is further defined by:

a converging conical portion adjacent to the work piece defining a converging substantially conical cavity; and a diverging conical portion opposite the work piece defining a diverging substantially conical cavity.

4. The apparatus of claim 3, wherein said slug capturing area is defined as the vertex of said converging conical portion and said diverging conical portion.

5. The apparatus of claim 4, further including a hydraulic pressure source configured to provide hydraulic pressure within the work piece within said die cavity, wherein said provided hydraulic pressure is sufficient to stretch the work piece outward to conform to the surface of said die cavity, but is insufficient to rupture a wall of the work piece into said first or second punch cavity portions.

6. The apparatus of claim 4, wherein said punch is retractable and the configuration of said slug capturing area is sufficient to capture a slug as said punch retracts.

7. The apparatus of claim 1, wherein said angular cutting face of said punch is a convex boss.

8. The apparatus of claim 7, further comprising:

a work piece in said die cavity, for piercing a hole to produce a slug; and wherein said angular cutting face is configured sufficiently to stretch said slug as said punch moves within said cross passage.

9. The apparatus of claim 7, further including a third die portion having a button cavity, wherein said second die portion is a button, flush mounted within said button cavity of said third die portion, wherein said slug capturing area is defined by an internal cavity of said button.

10. The apparatus of claim 9, wherein said internal cavity of said button is further defined by:

a converging conical portion adjacent to the work piece defining a converging substantially conical cavity; and a diverging conical portion opposite the work piece defining a diverging substantially conical cavity.

11. The apparatus of claim 10, wherein said slug capturing area is defined as the vertex of said converging conical portion and said diverging conical portion.

12. Apparatus for piercing a hole in a work piece suitable for a hydroforming application comprising:

a punch having an elongated body with an actuatable end and a piercing end on opposing ends thereof;

wherein said piercing end has an angular cutting face; and wherein said angular cutting face has a surface area greater than the cross-sectional area of said elongated body.

13. The apparatus of claim 12, further comprising:

a button having an inner cavity configured to allow lengthwise passage of said punch;

wherein said inner cavity has a converging conical portion and a diverging conical portion, wherein said converging conical portion is proximately closer to said punch; and wherein said elongated body and said inner cavity are configured with a diametrical clearance such that the portion of the work piece pierced by said piercing end of said punch will pass only one way through said inner cavity of said button.

14. The apparatus of claim 13, wherein said diametrical clearance is characterized as a slip fit.

15. The apparatus of claim 13, wherein said diametrical clearance is less than or equal to 0.005 inch.

16. The apparatus of claim 13, wherein said angular cutting face is a convex boss.

17. A method of piercing a hole with a punch in a work piece being hydroformed, comprising:

positioning the work piece in a die having a die cavity, wherein said die cavity is configured to receive the work piece;

applying sufficient pressure to the work piece, such that the work piece expands in said die cavity against said die;

advancing the punch sufficiently through a first wall of the work piece to pierce a first hole in said first wall and create a first slug therefrom;

expanding said first slug across a convex boss face of the punch as the punch advances through said first wall, thereby forming an expanded first slug;

passing said expanded first slug through a slug capturing area in said die having a smaller cross sectional area than said expanded first slug; and retracting the punch sufficiently back through said slug capturing area to strip said expanded first slug from the punch.

18. The method of claim 17, further comprising:

before passing said expanded first slug through said slug capturing area, advancing the punch and said expanded first slug sufficiently through a second wall of the work piece to pierce a second hole in said second wall to create and expand a second slug from said second wall, thereby forming an expanded second slug;

passing said expanded first slug and said expanded second slug through said slug capturing area; and retracting the punch sufficiently back through said slug capturing area to strip said expanded first slug and said expanded second slug from the punch.

* * * * *